US011732979B2

(12) United States Patent
Riondet et al.

(10) Patent No.: US 11,732,979 B2
(45) Date of Patent: Aug. 22, 2023

(54) COLLECTOR PLATE, CORRESPONDING HEADER BOX AND CORRESPONDING HEAT EXCHANGER

(71) Applicant: Valeo Systemes Thermiques, Le Mesnil Saint Denis (FR)

(72) Inventors: Christian Riondet, Reims (FR); Jean-Marc Lesueur, Reims (FR); Rémi Tournois, Le Mesnil Saint Denis (FR); Yves Seynat, Reims (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 779 days.

(21) Appl. No.: 16/321,707

(22) PCT Filed: Jul. 25, 2017

(86) PCT No.: PCT/FR2017/052064
§ 371 (c)(1),
(2) Date: Jan. 29, 2019

(87) PCT Pub. No.: WO2018/020138
PCT Pub. Date: Feb. 1, 2018

(65) Prior Publication Data

US 2021/0285732 A1 Sep. 16, 2021

(30) Foreign Application Priority Data

Jul. 29, 2016 (FR) ..... 1657377

(51) Int. Cl.
*F28F 9/02* (2006.01)
*F28D 1/053* (2006.01)

(52) U.S. Cl.
CPC ..... *F28F 9/0226* (2013.01); *F28D 1/05366* (2013.01)

(58) Field of Classification Search
CPC ..... F28F 9/0226; F28F 9/0224; F28F 9/0221; F28D 1/05366
(Continued)

(56) References Cited

U.S. PATENT DOCUMENTS 5,664,625 A * 9/1997 Letrange ..... F28F 9/02 165/149
6,988,544 B2 * 1/2006 Ozaki ..... B21D 53/085 165/173
(Continued)

FOREIGN PATENT DOCUMENTS

CN 101595360 A 12/2009
CN 103221773 A 7/2013
(Continued)

OTHER PUBLICATIONS

International Search Report and Written Opinion Issued in Corresponding PCT Application No. PCT/FR2017/052064, dated Oct. 13, 2017 (16 Pages with English Translation of International Search Report and Written Opinion).
(Continued)

*Primary Examiner* — Claire E Rojohn, III
(74) *Attorney, Agent, or Firm* — Osha Bergman Watanabe & Burton LLP

(57) ABSTRACT

The invention relates to a collector plate (11) for a heat exchanger (1), the collector plate (11) comprising:
- a peripheral groove (21) having a bottom (22),
- at least one upper step (25) protruding with respect to the bottom (22) of the said groove (21) over a predefined height (H1), and
- at at least one longitudinal end of the collector plate (11), an intermediate portion (27) between the upper step (25) and the said groove (21), According to the invention, at the said at least one longitudinal end of the collector plate (11), the said groove (21) has
(Continued)

an inner wall (23), at least one section of which connects the intermediate portion (27) to the bottom (22) of the said groove (21) and extends over a height (H2) which is not zero and is less than the height (H1) of the upper step (25). The invention also relates to a corresponding header box (3) and a corresponding heat exchanger (1).

14 Claims, 4 Drawing Sheets

(58) Field of Classification Search
USPC ..... 165/175
See application file for complete search history.

(56) References Cited

U.S. PATENT DOCUMENTS

| | | | | |
|---|---|---|---|---|
| 7,237,605 | B2 * | 7/2007 | Ozaki | F28F 9/182 165/149 |
| 9,297,594 | B2 * | 3/2016 | Riondet | F28F 9/0226 |
| 10,465,997 | B2 * | 11/2019 | Riondet | F28F 9/0226 |
| 2008/0000626 | A1 * | 1/2008 | Sugito | F28F 9/0226 165/173 |
| 2014/0196876 | A1 * | 7/2014 | Riondet | B23P 15/26 165/173 |
| 2018/0283806 | A1 * | 10/2018 | Riondet | F28F 9/0226 |
| 2019/0219337 | A1 * | 7/2019 | Twelves | F02C 7/141 |
| 2020/0256627 | A1 * | 8/2020 | Armsden | F28F 9/0263 |
| 2021/0207535 | A1 * | 7/2021 | Bergman | F28F 9/0221 |

FOREIGN PATENT DOCUMENTS

| | | | | |
|---|---|---|---|---|
| DE | 10 2012 200 516 | * | 7/2013 | |
| DE | 102012200516 | A1 | 7/2013 | |
| FR | 2945613 | A1 | 11/2010 | |
| WO | 2009008172 | A1 | 1/2009 | |
| WO | 2012068200 | A1 | 5/2012 | |
| WO | WO-2016188882 | A1 * | 12/2016 | F28F 9/0226 |

OTHER PUBLICATIONS

The First Office Action issued in corresponding Chinese Application No. 201780052838.7, dated Feb. 25, 2020 (8 pages).

* cited by examiner

Fig.1
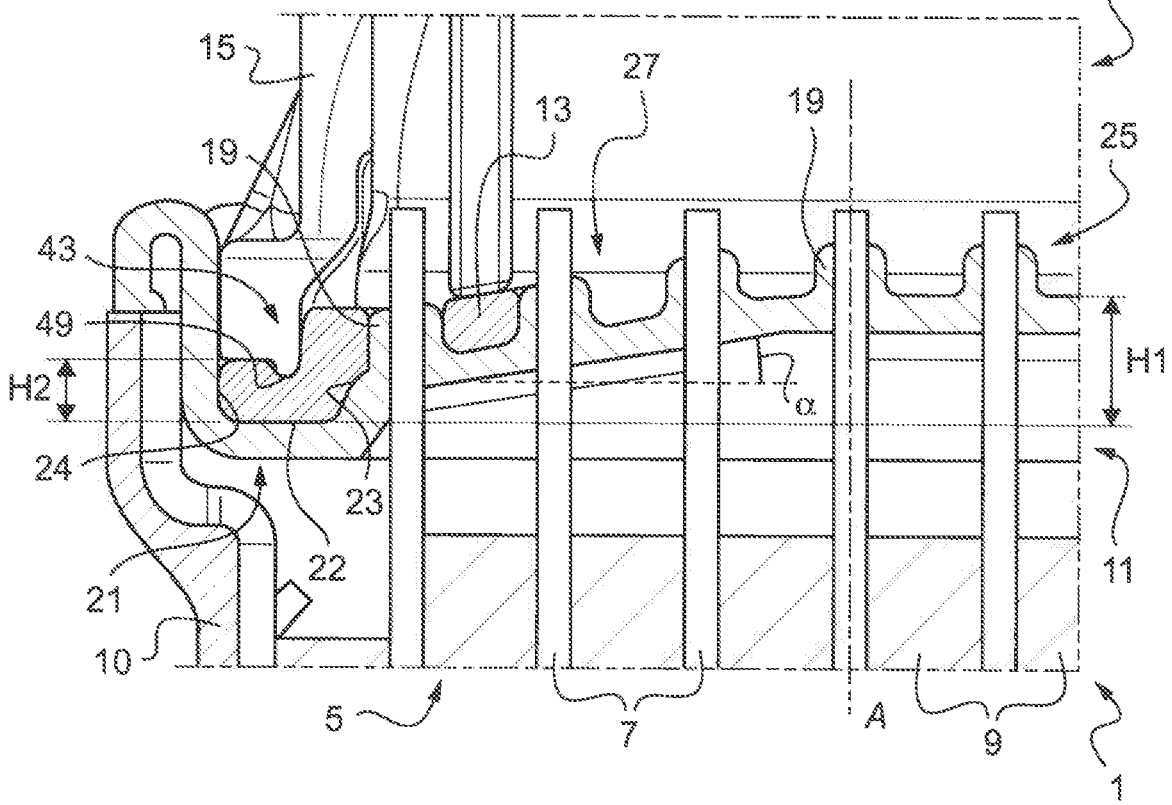
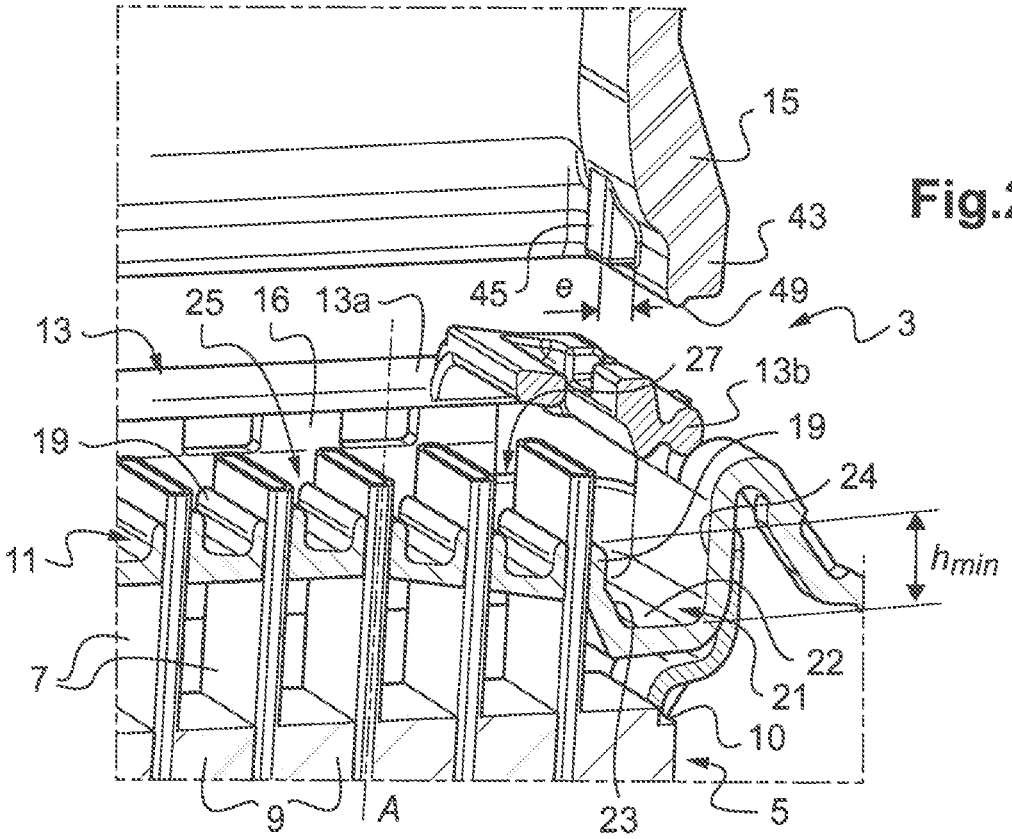
Fig.2

COLLECTOR PLATE, CORRESPONDING HEADER BOX AND CORRESPONDING HEAT EXCHANGER

The invention relates to a collector plate, in particular of a header box for a heat exchanger, in particular for a motor vehicle.

The invention also relates to a corresponding header box and a corresponding heat exchanger.

Heat exchangers which are used in motor vehicles, such as radiators for example for cooling the coolant of the engine, are known.

Generally, such a heat exchanger comprises a bundle of tubes and fins arranged between the tubes, and a header box. This header box comprises at least two parts: a collector plate receiving the ends of the tubes and a cover which is fixed onto the collector plate so as to close the header box while ensuring compression of a sealing means.

According to a known solution, the collector plate comprises a groove or channel intended to facilitate in particular positioning and keeping in place of the sealing means. The collector plate therefore has an upper step—or "embossment"—protruding with respect to the bottom of the peripheral groove and intended to be passed through by the heat exchange tubes. In order to facilitate the design of the collector plate and avoid the formation of too steep a slope between the bottom of the peripheral groove and the embossment, an intermediate portion may be provided between the bottom of the groove and the embossment, being in particular able to be inclined with respect to the plane defined by the embossment.

Once the header box has been assembled, the cover is positioned on the sealing means and then the cover is fixed onto the collector plate in order to close the header box. The sealing means thus compressed ensures sealing of the header box.

The sealing means in a known manner is made of polymer material. However, this material has an instability in particular due to variations in temperature and moisture.

In order to overcome this drawback, it is known to use an elastic sealing means and to tension it. In particular, according to a known solution, the sealing means is stretched around the end heat exchange tubes.

However, in the case of a collector plate with a groove, the latter is generally narrow and this may result in the incorrect positioning of the sealing means inside the groove.

In order to overcome this problem, a collector plate with groove having at each longitudinal end of the collector plate a flat zone between the bottom of the peripheral groove and the intermediate portion connecting the groove to the embossment has been provided. The orifices, which conventionally have collars along their edges and are intended to receive the end tubes, are formed in this flat zone. The sealing means is also arranged in this flat zone of the groove in order to be stretched around end tubes upon assembly of the heat exchanger.

However, during assembly of the header box, for example by means of crimping of the cover onto the collector plate, the sealing means may not be correctly kept in position in this flat zone of the groove.

Another drawback is that, during compression of the sealing means by the cover, the sealing means comes into contact with the ends of the heat exchange tubes emerging inside the header box. In particular, in the case of a heat exchanger assembled by means of brazing, these tubes are thin and the ends of the end tubes which make contact with the sealing means may be deformed as a result of the pressure exerted by the sealing means, thus reducing the heat exchange performance.

The aim of the invention is to overcome at least partially these problems of the prior art by proposing a collector plate which ensures optimum positioning of the sealing means intended to be arranged inside the peripheral groove of the collector plate upon assembly of the header box containing such a collector plate.

In order to achieve this aim the invention relates to a collector plate for a heat exchanger, the collector plate comprising:

- a peripheral groove having a bottom,
- at least one upper step protruding with respect to the bottom of the said groove over a predefined height, and
- at at least one longitudinal end of the collector plate, an intermediate portion between the upper step and the said groove.

According to the invention, at the said at least one longitudinal end of the collector plate, the said groove has an inner wall, at least one section of which connects the intermediate portion to the bottom of the said groove and extends over a height which is not zero and is less than the height of the upper step.

Them is therefore no flat zone between the bottom of the peripheral groove and the intermediate portion, but instead the inner wall connects the bottom of the peripheral groove to the intermediate portion. This inner wall does not extend over the entire height defined by the upper step, thus forming a partial groove offering an additional contact surface for a sealing means intended to be arranged inside the peripheral groove, compared to the solution of the prior art where there is a flat zone joining the bottom of the peripheral groove to the upper step.

According to an aspect of the invention, the collector plate comprises a plurality of orifices for receiving a plurality of heat exchange tubes of the heat exchanger, which are formed in the upper step and the intermediate portion, and at the said at least one longitudinal end of the collector plate, the end orifice is arranged on the intermediate portion.

In particular, the peripheral groove does not have an orifice for receiving a heat exchange tube. Consequently, the end orifice is present neither on the upper step nor inside the peripheral groove, but on the intermediate portion which forms the transition zone between the groove and the upper step, this making it possible to increase the contact surface area of the sealing means when it is arranged inside the peripheral groove and is stretched around collars conventionally formed along the edges of the end orifices. As a result it is possible to optimize the keeping in position of the sealing means during assembly of the header box, for example by means of crimping.

According to an embodiment, the inner wall of the said groove has, viewed in cross-section, a linear profile extending over a continuous height which is not zero and is less than the height of the upper step.

According to another embodiment the inner wall of the said groove has, viewed in cross-section, a profile which is at least partially curved. According to one aspect of this embodiment, at least the end sections of the inner wall along the transverse direction of the collector plate extend over a height which is not zero and is less than the height of the upper step.

Advantageously, the height of the said at least one section of the inner wall of the said groove ranges between one quarter and three quarters of the height of the upper step, in accordance with the following relation: $\frac{1}{4}H1 \leq H2 \leq \frac{3}{4}H1$, where H1 corresponds to the height of the upper step and H2 corresponds to the height of the said at least one section of the inner wall.

A gradual inclination, where the slope is not too great or steep, is thus obtained, resulting in a compact collector plate with a simple design.

The collector plate may also comprise one or more of the following characteristics considered separately or in combination:

- the upper step extends in a plane substantially parallel to the plane in which the bottom of the said groove extends;
- two or more collars are provided on the intermediate portion; this allows the overall dimensions to be reduced, in particular in the longitudinal direction of the collector plate; the peripheral groove comprises an inner wall and an outer wall situated opposite each other and connected by the bottom of the said groove;
- at the said at least one longitudinal end of the collector plate, the intermediate portion and the inner wall of the said groove extend in different and concurrent directions;
- at the said at least one longitudinal end of the collector plate, the inner wall of the said groove has a slope inclined in relation to the plane in which the bottom of the said groove extends; this makes it easier to perform drawing of the material;
- the intermediate portion is inclined in relation to the plane defined by the upper step, at an angle of inclination ranging from 5° to 25°, and preferably equal to about 10°; such an angle of inclination is advantageous with regard to the manufacturing process, in particular for manufacture of the collector plate by means of drawing.

The invention also relates to header box for a heat exchanger comprising:

- a collector plate as defined above,
- a compressible sealing means arranged at least partly inside the said peripheral groove of the collector plate, and
- a cover provided with a peripheral cover base seated at least partially inside the said groove of the collector plate, with the sealing means arranged in between, so as to close the header box while compressing the sealing means, and such that the upper step protrudes towards the cover in the assembled state of the header box.

The sealing means, once arranged inside the peripheral groove according to the invention, is thus kept in position in a simple manner. The mechanical strength of the header box is thus increased.

According to an aspect of the invention, the collector plate comprises protruding collars formed along the edges of the orifices, the collars extending towards the inside of the header box at different heights along the intermediate portion (the size of each of the collars—i.e. height of the collar between the base and the top of the collar—being substantially identical for each collar of the collector plate), and the sealing means has, before compression, a maximum height less than or the same as the height of the lowest collar (height in relation to the bottom of the groove). According to another possible embodiment, the sealing means may have a height slightly greater than the height of the lowest collar (ranging from a few nanometres to 1 or 2 millimetres).

The invention also relates to a heat exchanger, in particular for a motor vehicle, comprising a bundle of heat exchange tubes. According to the invention, the heat exchanger comprises at least one collector plate as defined above.

According to an aspect of the invention, the heat exchanger comprises two header boxes as defined above, and the ends of the heat exchange tubes are respectively fixed to the two header boxes.

According to an aspect of the invention the said bundle comprises an alternating stacked arrangement of heat exchange tubes and heat exchange fins.

Advantageously the exchanger is assembled by means of brazing.

Further characteristic features and advantages of the invention will emerge more clearly from a reading of the following description provided by way of a non-limiting example and from the attached drawings in which:

FIG. 1 is a cross-sectional view showing partially a heat exchanger comprising a collector plate according to a first embodiment;

FIG. 2 is an exploded partial view of the heat exchanger according to FIG. 1;

Figure 3A:
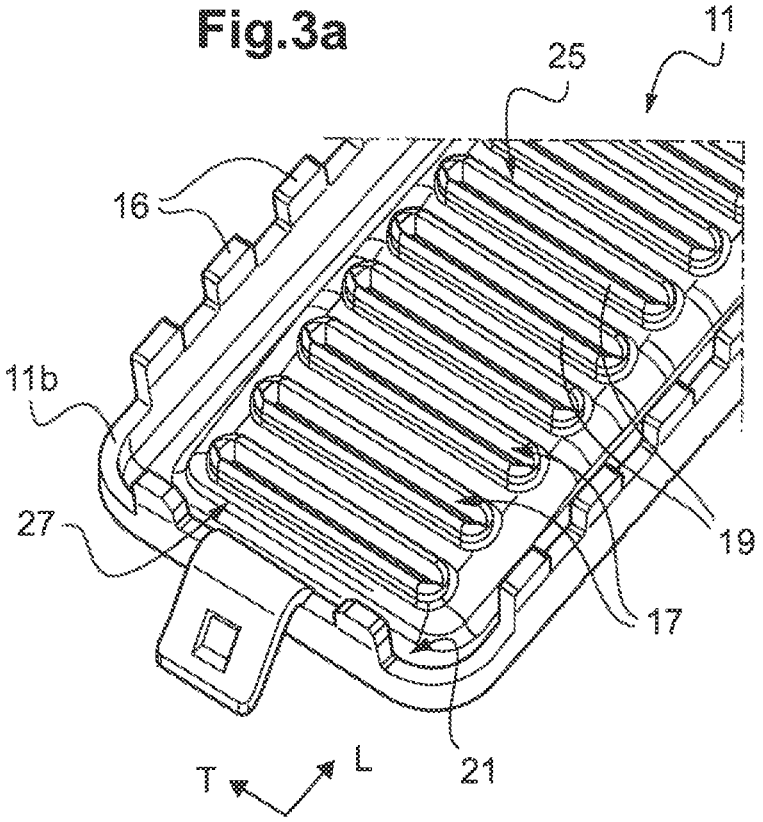
Figure 3B:
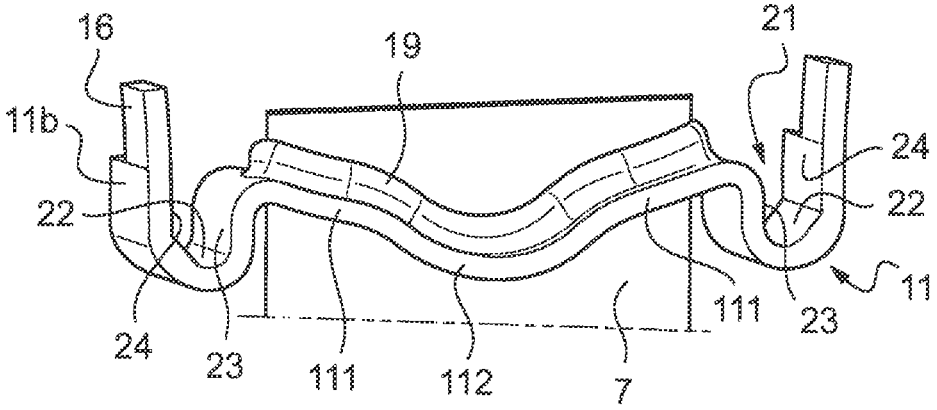
Figure 4A:
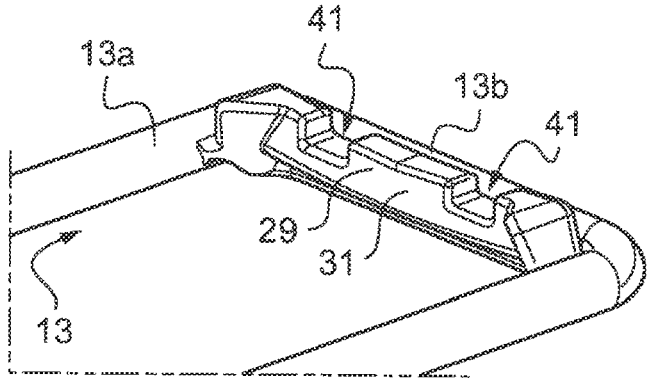
Figure 4B:
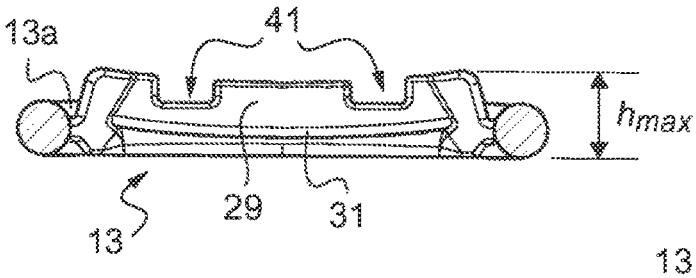

FIG. 3*a* is a partial perspective view showing the collector plate of the heat exchanger according to FIGS. 1 and 2;

FIG. 3*b* is a cross-sectional view of the collector plate according to a second embodiment;

FIG. 4*a* is a perspective view showing partially a first variation of embodiment of a seal of the heat exchanger according to FIGS. 1 and 2;

FIG. 4*b* is a cross-sectional view of the seal according to FIG. 4*a;*

Figure 4C:
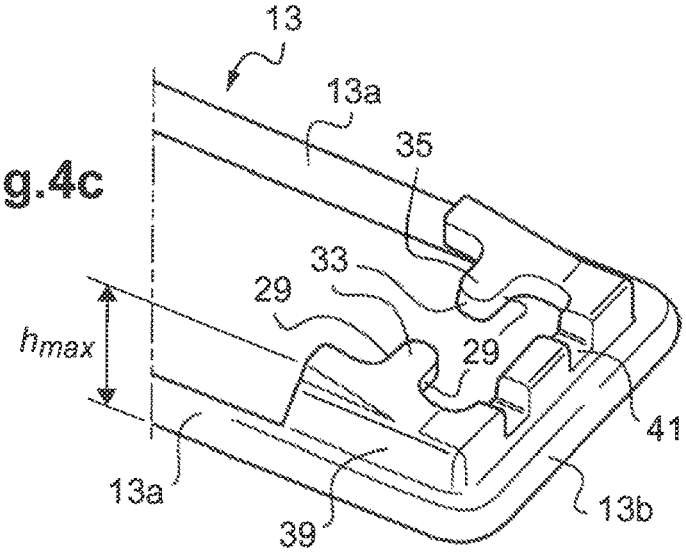
Figure 4D:
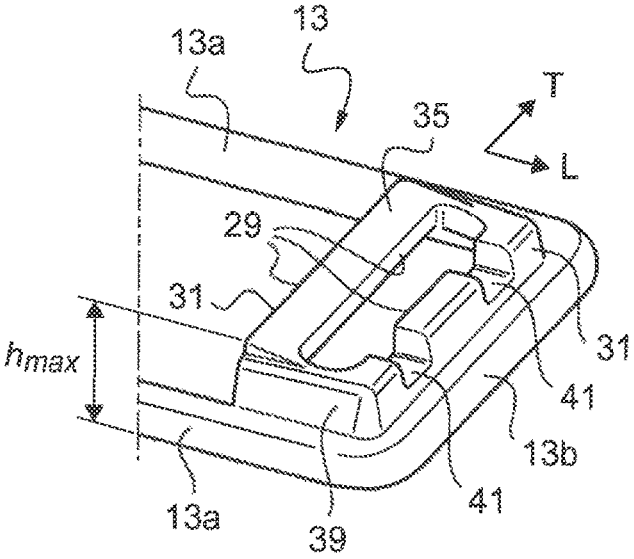
Figure 5:
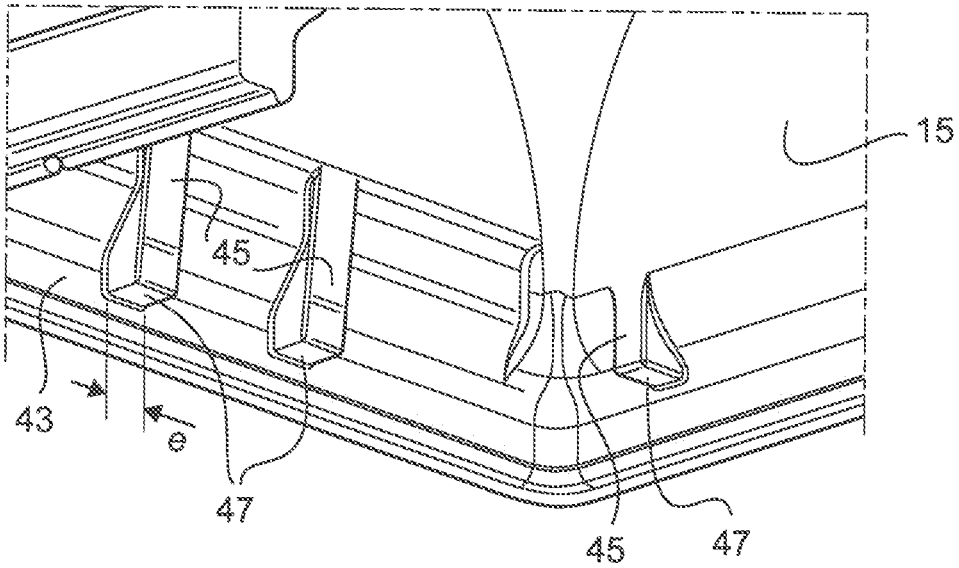
Figure 6:
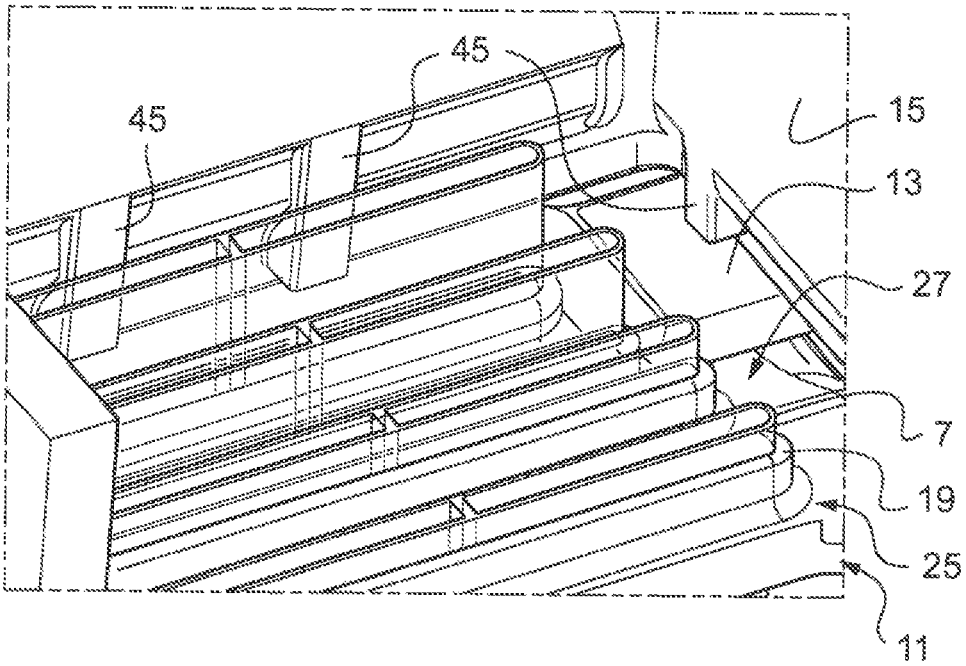

FIG. 4*c* is a partial cross-sectional view of a seal according to a second variation of embodiment;

FIG. 4*d* is a partial cross-sectional view of a seal according to a third variation of embodiment;

FIG. 5 is a partial perspective view showing a cover of the header box of the heat exchanger according to FIGS. 1 and 2; and FIG. 6 is a partial view showing the inside of the header box according to FIG. 2 in the assembled state.

In these figures, identical elements have the same reference numbers.

The following embodiments are examples. Although the description refers to one or more embodiments, this does not necessarily mean that each reference relates to the same embodiment or that the characteristic features apply to only one embodiment. Simple characteristic features of different embodiments may also be combined or interchanged in order to provide other embodiments.

Some of the figures show a reference letter L, T, corresponding to a horizontal plane, the axis L corresponding to a longitudinal axis and the axis T corresponding to a transverse axis.

In the present description, the terms vertical/horizontal or upper/lower are indicated with reference to the arrangement of the elements in the figures, which corresponds generally to the arrangement of the elements in the assembled state in the motor vehicle.

With reference to FIGS. 1 and 2, the invention relates to a heat exchanger 1 for a motor vehicle, in particular for cooling the coolant of the engine. Advantageously, the invention applies to a heat exchanger 1 which is brazed, namely where the different elements are assembled by means of brazing.

The heat exchanger 1 comprises at least one header box 3, generally two header boxes 3, the or each header box 3 allowing a first fluid such as the coolant to be collected and distributed. More particularly, the invention relates to such a header box 3 and a collector plate 11 of such a header box 3.

The heat exchanger 1 comprises moreover a bundle 5 formed by a multiplicity of heat exchange tubes 7, for example made of aluminium, which are arranged so as to form one or more rows of tubes. The heat exchange tubes 7 define respectively one or more channels along which a first fluid, for example the coolant, flows. By way of a non-limiting example, the heat exchange tubes 7 are flat tubes. Moreover, the heat exchange tubes 7 extend respectively along a longitudinal axis A. In this example, the longitudinal axis A is substantially vertical with reference to the arrangement of the elements shown in FIGS. 1 and 2.

Only one end of the heat exchange tubes 7 is visible in FIGS. 1 and 2. According to an embodiment, the ends of the heat exchange tubes 7 are respectively fixed to two header boxes 3.

The bundle 5 may comprise moreover a plurality of heat exchange fins 9—shown schematically in FIGS. 1 and 2—arranged in an alternate manner with the heat exchange tubes 7. The heat exchange fins 9 are advantageously designed to disturb the flow of a second fluid such as an air flow between the heat exchange tubes 7, so as to increase the heat exchange area between the two fluids.

The bundle 5 may also comprise two side cheeks 10 arranged on either side of the stack of heat exchange tubes 7 and heat exchange fins 9. These side cheeks 10 are assembled by means of brazing together with the rest of the bundle 5 in the case of a brazed heat exchanger 1.

As regards more particularly the header box 3, the latter comprises:

- a collector plate 11,
- a sealing means such as a seal 13, and
- a cover 15 which closes the header box 3 while compressing the seal 13.

The collector plate 11, which is visible more clearly in FIG. 3, is for example made of aluminium or an aluminium alloy. The collector plate 11 extends longitudinally in the direction L. The direction T is perpendicular to the direction L, overall within the plane of extension of the collector plate 11.

It is possible to provide on the collector plate 11 fixing means such as crimping lugs 16 which are designed to be crimped onto edges of the cover 15. For this purpose, the collector plate 11 may have edges or flanges 11*b* on which the fixing means such as crimping lugs 16 are provided. These consist for example of folded edges 11*b*.

Moreover, the collector plate 11 has a plurality of orifices 17 for receiving the ends of the heat exchange tubes 7. According to the embodiments shown, these orifices 17 are respectively provided with collars 19 along their edges. According to the embodiment shown, the collars 19 protrude with respect to the collector plate 11 and extend towards the inside of the header box 3, when the cover 15 is assembled on the collector plate 11.

The collector plate 11 also comprises a peripheral groove 21 for receiving at least a part of the seal 13.

As can be seen more clearly in FIG. 1, this peripheral groove 21 has a bottom 22 and a side wall, called inner wall 23. Inner wall is understood as meaning that this wall is situated on the inside of the collector plate 11. The groove 21 has moreover a side wall 24 situated opposite the inner wall 23, called outer wall 24. The inner wall 23 is closest to the orifices 17 and the collars 19. The outer wall 24, namely the wall furthest from the orifices 17 and the collars 18, is formed on the edges 11*b* of the collector plate 11. The two side walls 23, 244 are connected by the bottom 22. The bottom 22 extends for example in a plane substantially perpendicular to the folded edges 11*b* of the collector plate 11.

Moreover, the collector plate 11 comprises at least one upper step 25 protruding with respect to the bottom 22 of the peripheral groove 21. The upper step 25 extends over a predefined height H1 in relation to the bottom of the peripheral groove 21. This height H1 of the upper step 25 may for example correspond to the extension height of the edges 11*b* of the collector plate 11.

The upper step 25 therefore extends along a plane which is different from and above the plane along which the bottom 22 of the peripheral groove 21 extends, with reference to the arrangement of the elements shown in FIGS. 1 to 3. In other words, the upper step 25 is raised with respect to the bottom 22 of the peripheral groove 21. In particular, the upper step 25 extends along a plane parallel to the plane in which the bottom 22 of the peripheral groove 21 extends. The upper step 25 is also referred to as an "embossment".

At at least one longitudinal end of the collector plate 11, preferably at each longitudinal end, the collector plate 11 also comprises an intermediate portion 27 connecting the upper step 25 to the peripheral groove 21. According to the embodiment shown, the intermediate portion 27 is inclined in relation to the plane defined by the upper step 25 at an angle of inclination a schematically indicated in FIG. 1. This angle of inclination a for example ranges from 5° to 25°, and is preferably equal to about 10°.

Moreover, at one or at the two longitudinal ends of the collector plate 11, the inner wall 23 of the peripheral groove 21 has at least one section connecting the intermediate portion 27 to the bottom 22 of the groove 21 and extending over a height H2 which is not zero and is less than the height H1 of the upper step 25. The heights H1 and H2 are considered in relation to the bottom 22 of the peripheral groove 21.

The groove 21 is also referred to as a partial groove 21. In fact, the height of the inner wall 23 of the peripheral groove 21 corresponds to the minimum height H2 of the intermediate portion 27 and not to the height H1 of the upper step 25 (or maximum height of the intermediate portion 27). Thus, at a longitudinal end or preferably at two longitudinal ends of the collector plate 11, the inner wall 23 is for example smaller than the outer wall 24.

Moreover, the orifices 17 which advantageously have collars 19 along their edges are formed on the upper step 25 and the intermediate portion 27. The collector plate 11 has a core comprising the upper step 25 and the intermediate portion 27. For example, two or three collars 19 are formed on the intermediate portion 27. As a result the collars 19 are not all at the same height along the intermediate portion 27.

Furthermore, at at least one longitudinal end of the collector plate 11, the end orifice 17 is arranged on the intermediate portion 27. The collar 19 along the edge of this end orifice 17 is therefore arranged on the intermediate portion 27. According to a preferred embodiment, the collector plate 11 has such an intermediate portion 27 at the two longitudinal ends, and the two end orifices 17 are respectively formed on an associated intermediate portion 27.

Thus, the peripheral groove does not have an orifice 17 for receiving a heat exchange tube. There is also no flat zone between the peripheral groove 21 and the intermediate portion 27. In other words, the intermediate portion 27 is directly connected to the inner wall 23 of the peripheral groove 21 without any transition zone between them.

According to a first embodiment shown in FIGS. 1 to 3*a*, the core of the collector plate 11, on which the orifices 17 advantageously with collars 19 along their edges are formed, has viewed in cross-section a substantially linear profile over a same height. In this case, in a complementary manner, the inner wall 23 also has a substantially linear profile viewed in cross-section and extends over a continuous height H2 which is not zero and is less than the height H1 of the upper step 25.

Moreover, according to this first embodiment, the intermediate portion 27 extends, along the longitudinal direction L of the collector plate 11, over a progressive height between a maximum height H1 and a minimum height H2 which is not zero and is less than the maximum height H1.

According to a second embodiment, the core of the collector plate 11 has, viewed in cross-section, an at least partially curved profile.

According to an example of embodiment not shown, the core of the collector plate 11 may have, viewed in cross-section, a profile following a simple curve of a given radius of curvature.

According to an alternative embodiment shown in FIG. 3*b*, the core of the collector plate 11 may have a profile with at least two curves. In this example, the core of the collector plate 11 may have a profile comprising two lateral portions 111 following overall a curve of a first of radius of curvature and a central portion 112 joining together the lateral portions 111 and following overall a curve of a second radius of curvature. The central portion 112 and lateral portion III form, for example, each a hump towards the outside of the header box in the assembled state and therefore downwards in FIG. 3*b*. By way of a variant, it could be envisaged, for example, that the central portion 112 forms a hump towards the inside of the header box 11.

In this case, in a complementary manner, the inner wall 23 has, viewed in cross-section, a profile with two end sections following overall the curve of a first radius of curvature and a central section following the curve of a second radius of curvature. At least the end sections of the inner wall 23 in the transverse direction Y of the collector plate 11 extend over a height H2 which is not zero and is less than the height H1 of the upper step 25.

According to a first variant, it is possible to envisage that the minimum height for the lowest point of at least one curve of the cross-sectional profile in the region of the inner wall 23 is zero.

According to a second variant, it is possible to envisage that the minimum height of the lowest points of each of the curves of the cross-sectional profile in the region of the inner wall 23 is zero.

Moreover, according to this second embodiment, at least the longitudinal edges of the intermediate portion 27 extend, along the longitudinal direction L of the collector plate 11, over a progressive height between a maximum height H1 and a minimum height H2 which is not zero and is less than the maximum height H1.

According to one or the other of the embodiments of the collector plate 11, the height H2 of at least one section or of all the inner wall 23 is for example between one quarter and three quarters of the height H1 of the upper step 25, in accordance with the following relation: $\frac{1}{4}H1 \leq H2 \leq \frac{3}{4}H1$.

Moreover, at at least one longitudinal end of the collector plate 11, the inner wall 23 of the peripheral groove 21 may have a slope. The slope of the side wall 23 is inclined with respect to the plane of the opposite side wall 24 and also with respect to the plane along which the bottom 22 of the peripheral groove 21 extends. According to the example shown, the plane of the side wall 24 is a vertical wall and the plane of the bottom 22 is a horizontal plane with reference to the arrangement of the elements shown in FIG. 1. The slope of the side wall 23 of the peripheral groove 21 extends in the example shown in a direction different from the direction of extension of the intermediate portion 27. These directions consist in particular of concurrent directions.

According to a particular embodiment, the slope is solely provided at the longitudinal ends of the collector plate 11, namely along the short sides of the collector plate 11. On the other hand, the side wall 23 does not have such a slope along the long sides of the collector plate 11 and extends substantially parallel to the opposite side wall 24. In this case, the peripheral groove 21 has for example a cross-section substantially in the form of a U elsewhere than at the longitudinal ends of the collector plate 11.

With reference to FIGS. 4*a* to 4*d*, the sealing means such as a seal 13 are described in greater detail. The seal in question is a compressible seal 13 arranged inside the peripheral groove 21 of the collector plate 11 (FIG. 1). The seal 13 has a form which complements that of said peripheral groove 21. In this example, the seal 13 has a peripheral part with a substantially rectangular form with two opposite long sides 13 and two opposite short sides 13*b*. This peripheral part may have by way of a non-limiting example a substantially circular cross-section. In particular, the short sides 13*b* of the seal have for example a form complementing that of the slope of the inner wall 23 of the peripheral groove 21 at one or each longitudinal end of the collector plate 11 (FIGS. 1 and 2). For this purpose, the seal 13 may have on the bottom part along its short sides 13*b* a slope arranged on the slope of the inner wall 23 of the peripheral groove 21.

In the assembled state of the header box 3, the seal 13 is arranged between the cover 15 and the collector plate 11, the cover 15 compressing the seal so as to close the header box 3 while ensuring the fluid-tightness of the header box 3.

Advantageously the seal 13 is elastic and is tensioned when it is arranged on the collector plate 11.

Moreover, the seal 13 has for example at least one contact surface 29—visible more clearly in FIGS. 4*a* to 4*d*—which is configured to make contact against one of the collars 19 when the seal 13 is compressed. In particular, at least one contact surface 29 is arranged against an end collar 19 along the edge of the first or last orifice 17.

According to the embodiments shown, the seal 13 when it is compressed makes contact solely against a collar 19, in particular with its contact surfaces 29, and not against an end of the heat exchange tube 7 emerging inside the header box 3. The seal 13 does not have any surface configured to make contact against the ends of the heat exchange tubes 7. To achieve this, the seal 13 is kept at a distance from the ends of the heat exchange tubes 7 by means of collars 19 arranged between the seal 13 and the ends of the heat exchange tubes 7. In other words, a collar 19 is always present between the seal 13, and more precisely the contact surfaces 29, and one end of the heat exchange tube 7.

Thus, in the assembled state of the heat exchanger 1, the seal 13 compressed by the cover IS does not make any contact with the ends of the heat exchange tubes 7 emerging inside the header box 3.

According to the embodiments described, the seal 13 comprises at least one retaining portion 31, 33 extending in the transverse direction T, i.e. along the width of the seal 13, in other words here along the direction of the short sides 13*b* of the seal 13. In particular, at least one retaining portion 31 extends along the transverse direction T between a short side 13*b* of the seal 13 and an end collar 19. The contact surface(s) 29 of the seal 13 which make contact against a collar 19 are formed on these retaining portions 31 and/or 33, more precisely on one or each side of the retaining portions 31, 33.

More precisely, the retaining portion(s) 31, 33 are raised in relation to the peripheral part 13*a*, 13*b* of the seal 13. In this case, connecting parts 39 connect the retaining portion(s) 31, 33 to the peripheral part 13*a*, 13*b* of the seal 13.

One or more retaining portions 31 may consist of transverse bands 31. In this case, the transverse bands 31 extend so as to join together the connecting parts 39 which are respectively connected to a long side 13*a* of the seal 13. The width of a transverse band 31 is substantially equal to the width between two successive collars 19. By way of a non-limiting example, the width of a transverse band 31 is in the range of 2.5 mm to 5 mm.

By way of a variant or in addition, one or more retaining portions 33 may be formed as lugs 33 which extend from a connecting portion 39 connected to a long side 13*a* towards the opposite connecting portion 39 connected to the other long side 13*a*, without reaching it, as shown in FIG. 4*c*.

In particular, at least one retaining portion 31 may be adjacent to a short side 13*b* of the seal. According to the examples shown in FIGS. 4*a* to 4*d*, it consists of a transverse band 31 which has one or more recesses 41 for cooperating with the cover 15, as will be described in mom detail below.

The retaining portions 31 and/or 33 may also have a flat surface 35 on their upper face arranged facing the cover 15 in the assembled state of the header box 3.

The retaining portions 31 and/or 33 are advantageously formed as one piece with the peripheral part 13*a*, 13*b* of the seal 13. In order to simplify further the production of such a part, the peripheral part 13*a*, 13*b* and the retaining portions 31 and/or 33 may be made of a single material.

Only one longitudinal end of the seal 13 is visible in the figures. Of course, it is possible to envisage that the seal 13 is formed in a similar manner at its other longitudinal end with one or more retaining portions 31 and/or 33, and in particular, the seal 13 according to this second embodiment may be symmetrical in relation to a mid-plane.

Moreover, the seal 13 may have before compression a maximum height hmax (FIGS. 4*b* to 4*d*) less than or equal to the height hmin of the lowest collar 19 (see FIG. 2). Mom precisely, the maximum height hmax corresponds to the height of the retaining portions 31, 33 which are raised in relation to the peripheral part 13*a*, 13*b*. As regards the lowest collar 19, this is the end collar 19 arranged at the start of the intermediate portion 27, i.e. closest to the peripheral groove 21.

Finally, with reference to FIGS. 1, 2 and 5, the cover 15 is described in greater detail. It may consist of a cover 15 made of plastic or aluminium alloy.

The cover 15 may have a substantially arch-like general form. In particular, the cover 15 comprises a peripheral cover base 43 closing the header box 3 while compressing the seal 13. The expression "cover base" is understood as meaning the bottom part of the cover 15 which rests on the seal 13 and which cooperates with the collector plate 1I so as to be fixed, for example by means of crimping lugs 16 which are present on the periphery or the circumference of the collector plate 11 and which are folded over, during crimping, onto the cover 15.

As can be seen more clearly in FIGS. 2 and 5, the cover base 43 has a predefined number of projections 45 protruding from the inner wall of the cover base 43 and extending towards the seal 13 on the collector plate 11, so as to make contact against the seal 13. In particular, the projections 45 protrude over a thickness e from the inner wall of the cover base 43. The projections 45 are therefore formed inside the volume defined by the cover 15.

The thickness e is for example chosen sufficiently large so that at least one projection 45 of the cover base 43 makes contact against a retaining portion 31 or 33 of the sealing means 13, in the assembled state of the header box 3. In particular, one or more of the projections 45 may rest on the retaining portion 31 adjacent to the short side 13*b* of the seal 13 engaging over a given height, inside a recess provided for this purpose on the retaining portion 31. These projections 45 keep the seal 13 in position and prevent the seal from being displaced or being deformed during assembly, not only during assembly but also during the different heat cycles of the heat exchanger 1. Thus, the projections 45 help keep the seal 13 at a distance from the ends of the heat exchange tubes 7.

Moreover, each projection 45 has a bottom part 47 which rests on the sealing means 13 as schematically shown in FIG. 6. The projections 45 are advantageously formed as one piece with the cover 15, for example by means of injection.

The projections 45 extend in this example in a manner substantially parallel to the axis A.

Moreover, in the example shown, the cover base 43 is offset in relation to the arch form of the cover 15. In other words, the cover base 43 allows a flange to be defined as can be seen in FIG. 1.

The projections 45 are for example aligned with or, expressed in other words, are arranged as a continuation of the inner wall of this arch form of the cover 15, as may be clearly seen in FIGS. 2 and 5.

The cover base 43 has a form matching the form of the peripheral contour of the collector plate 11, which is substantially rectangular in this case. The projections 45 may be provided on one or both the opposite short sides of the cover base 43. By way of a variant or in addition, the projections 45 may be provided on one or both the long opposite sides of the cover base 43. In particular, a projection 45 may be arranged between the end collar 19 and the corner of the header box 3 (see FIG. 6).

Moreover, the projections 45 may respectively have a contour which reduces the risk of damaging the seal 13 during assembly of the header box 3, for example the corners or edges may be substantially rounded.

Finally, the cover base 43 may be provided with a matching form 49, visible in FIGS. 1 and 2, such as a rib extending axially towards the cover base 43 so as to rest between a short side 13*b* and an adjacent retaining portion 31.

Thus, during assembly of the heat exchanger 1, the bundle 5 of heat exchange tubes 7 and the collector plate 11 are brazed together. The seal 13 is positioned inside the peripheral groove 21 of the collector plate 11 and then the cover 15 is crimped onto the collector plate 11, in particular with the aid of the crimping lugs 16, with the seal 13 arranged between the cover base 43 and the collector plate 11.

The seal 13, and in particular its peripheral part 13*a*,13*b*, ensures the fluid-tightness between the collector plate 11 and the cover 15.

The form of the partial groove 21 of the collector plate 11 as described above allows the contact surface area of the seal 13 to be increased inside the peripheral groove 11, while ensuring that the seal 13 remains in position not only during crimping but also during the heat cycles of the heat exchanger 1.

What is claimed:

1. A collector plate for a heat exchanger, the collector plate comprising:

first and second longitudinal ends;

a plurality of orifices, disposed between the first and second longitudinal ends, for receiving a plurality of heat exchange tubes of the heat exchanger;

the orifices including a first end orifice disposed at the first longitudinal end and a second end orifice disposed at the second longitudinal end;

a plurality of protruding collars disposed along edges of each of the orifices, wherein a first one of the protruding collars is disposed along edges of the first end orifice;

a peripheral groove having a bottom and an outer wall;

at least one upper step protruding with respect to the bottom of the peripheral groove over a predefined height; and an intermediate portion disposed between the upper step and the peripheral groove, wherein the intermediate portion includes the first end orifice, at the first longitudinal end of the collector plate, and the first protruding collar, and wherein the peripheral groove has an inner wall connecting the first protruding collar to the bottom of the peripheral groove and extending over a height which is not zero and which is less than the predefined height of the upper step, whereby the peripheral groove is bounded by the protruding collar, the inner wall, the bottom and the outer wall, and wherein the intermediate portion includes at least two of the protruding collars, that are disposed at different heights along the intermediate portion.

2. The collector plate as claimed in claim 1, wherein the plurality of orifices are formed in the upper step and the intermediate portion.

3. The collector plate as claimed in claim 1, wherein the inner wall of the groove has, viewed in cross-section, a linear profile over a continuous height which is not zero and is less than the predefined height of the upper step.

4. The collector plate as claimed in claim 1, wherein:

the inner wall of the groove has, viewed in cross-section, a profile which is at least partially curved, and wherein at least the end sections of the inner wall along the transverse direction of the collector plate extend over the height which is not zero and which is less than the predefined height of the upper step.

5. The collector plate as claimed in claim 1, wherein the height of the said at least one section of the inner wall of the said groove is between one quarter and three quarters of the height (H1) of the upper step, in accordance with the following relation: $\frac{1}{4}H1 \leq H2 \leq \frac{3}{4}H1$, where H1 corresponds to the predefined height of the upper step and H2 corresponds to the height of the said at least one section of the inner wall.

6. The collector plate as claimed in claim 1, wherein the upper step extends in a plane substantially parallel to a plane in which the bottom of the groove extends.

7. The collector plate as claimed in claim 1, wherein at the at least one longitudinal end of the collector plate, the intermediate portion and the inner wall of the groove extend in different and concurrent directions.

8. The collector plate as claimed in claim 1, wherein at the said at least one longitudinal end of the collector plate, the inner wall of the groove has a slope inclined in relation to a plane in which the bottom of the said groove extends.

9. The collector plate as claimed in claim 1, wherein the intermediate portion is inclined in relation to a plane defined by the upper step with an angle of inclination ranging from 5° to 25.

10. A header box for a heat exchanger comprising:

a collector plate comprising:

first and second longitudinal ends;

a plurality of orifices, disposed between the first and second longitudinal ends, for receiving a plurality of heat exchange tubes of the heat exchanger;

the orifices including a first end orifice disposed at the first longitudinal end and a second end orifice disposed at the second longitudinal end;

a plurality of protruding collars disposed along edges of each of the orifices, wherein a first one of the protruding collars is disposed along edges of the first end orifice;

a peripheral groove having a bottom and an outer wall;

at least one upper step protruding with respect to the bottom of the peripheral groove over a predefined height, and an intermediate portion disposed between the upper step and the peripheral groove, wherein the intermediate portion includes the first end orifice, at the first longitudinal end of the collector plate, and the first protruding collar, and wherein the peripheral groove has an inner wall connecting the first protruding collar to the bottom of the peripheral groove and extending over a height which is not zero and which is less than the predefined height of the upper step, whereby the peripheral groove is bounded by the protruding collar, the inner wall, the bottom and the outer wall, and wherein the intermediate portion includes at least two of the protruding collars, that are disposed at different heights along the intermediate portion;

a compressible sealing means arranged at least partly inside the said groove of the collector plate; and a cover provided with a peripheral cover base seated at least partially inside the said groove of the collector plate, with the sealing means arranged in between, so as to close the header box while compressing the sealing means, wherein the at least one upper step protrudes towards the cover in an assembled state of the header box.

11. The header box as claimed in claim 10, wherein:

the protruding collars extend towards the inside of the header box at different heights along the intermediate portion, and the sealing means has, before compression, a maximum height less than or equal to a height of a lowest one of the collars.

12. A heat exchanger for a motor vehicle, comprising:

a bundle of heat exchange tubes; and at least one collector plate comprising:

first and second longitudinal ends;

a plurality of orifices, disposed between the first and second longitudinal ends, for receiving the bundle of heat exchange tubes;

the orifices including a first end orifice disposed at the first longitudinal end and a second end orifice disposed at the second longitudinal end;

a plurality of protruding collars disposed along edges of each of the orifices, wherein a first one of the protruding collars is disposed along edges of the first end orifice;

a peripheral groove having a bottom and an outer wall, at least one upper step protruding with respect to the bottom of the peripheral groove over a predefined height, and an intermediate portion disposed between the upper step and the peripheral groove, wherein the intermediate portion includes the first end orifice, at the first longitudinal end of the collector plate, and the first protruding collar, and wherein the peripheral groove has an inner wall connecting the first protruding collar to the bottom of the peripheral groove and extending over a height which is not zero and which is less than the predefined height of the upper step, whereby the peripheral groove is bounded by the protruding collar, the inner wall, the bottom and the outer wall, and wherein the intermediate portion includes at least two of the protruding collars, that are disposed at different heights along the intermediate portion.

13. The heat exchanger as claimed in claim 12, assembled by means of brazing.

14. The collector plate according to claim 1, wherein the intermediate portion is defined between upper and lower surfaces, and both the upper and lower surfaces change in height between the peripheral groove and the at least one upper step.

* * * * *